US007665682B2

(12) United States Patent
Stahlecker et al.

(10) Patent No.: US 7,665,682 B2
(45) Date of Patent: Feb. 23, 2010

(54) CROSSWOUND BOBBIN AND ASSOCIATED PRODUCTION METHOD

(75) Inventors: Gerd Stahlecker, Eislingen/Filz (DE); Gernot Schäffler, Waschenbeuren (DE); Christoph Riethmüller, Leonberg (DE)

(73) Assignee: Deutsche Institute fuer Textil- und Faserforschung Stuttgart Stiftung des oeffentlichen Rechts, Denkendorf (DE)

( * ) Notice: Subject to any disclaimer, the term of this patent is extended or adjusted under 35 U.S.C. 154(b) by 259 days.

(21) Appl. No.: 10/590,807

(22) PCT Filed: Feb. 25, 2005

(86) PCT No.: PCT/EP2005/002024

§ 371 (c)(1),
(2), (4) Date: Dec. 22, 2006

(87) PCT Pub. No.: WO2005/082758

PCT Pub. Date: Sep. 9, 2005

(65) Prior Publication Data

US 2008/0156917 A1 Jul. 3, 2008

(30) Foreign Application Priority Data

Feb. 27, 2004 (DE) ..... 10 2004 010 824

(51) Int. Cl.
*B65H 55/04* (2006.01)

(52) U.S. Cl. ..... 242/178; 242/476.7

(58) Field of Classification Search ..... 242/476.7, 242/477.1, 477.2, 477.3, 477.4, 477.5, 477.6, 242/477.7, 477.8, 479.2, 479.3, 479.6, 178
See application file for complete search history.

(56) References Cited

U.S. PATENT DOCUMENTS

| | | | | |
|---|---|---|---|---|
| 1,770,397 | A * | 7/1930 | Furness | 242/477.2 |
| 2,205,385 | A | 6/1940 | Abbot | |
| 2,268,554 | A | 1/1942 | Abbot | |
| 2,358,752 | A | 9/1944 | White | |
| 4,204,653 | A | 5/1980 | Nose et al. | |
| 4,462,558 | A | 7/1984 | Stahlecker et al. | |
| 4,659,027 | A | 4/1987 | Schippers et al. | |
| 2003/0161979 | A1 | 8/2003 | Koyanagi et al. | |
| 2004/0104290 | A1 | 6/2004 | Planck et al. | |
| 2004/0173711 | A1 | 9/2004 | Schuttrichkeit | |

FOREIGN PATENT DOCUMENTS

CN 1440362 A 9/2003

(Continued)

*Primary Examiner*—John Q Nguyen
*Assistant Examiner*—William E Dondero
(74) *Attorney, Agent, or Firm*—The Nath Law Group; Jerald L. Meyer; Stanley N. Protigal

(57) ABSTRACT

An overend take-off crosswound bobbin and a method for its production are designed in such a way that the density of the finished crosswound bobbin is increased and the run-off characteristics during further processing are optimized. For this purpose, in one variant parallel windings are introduced at intervals. In another variant, when the bobbin diameter is small the yarn is wound on at a smaller pitch angle than for a larger diameter. Furthermore, a traversing stroke which is reduced by comparison with the bobbin width is displaced along the bobbin width.

14 Claims, 3 Drawing Sheets

FOREIGN PATENT DOCUMENTS

Figure 1:
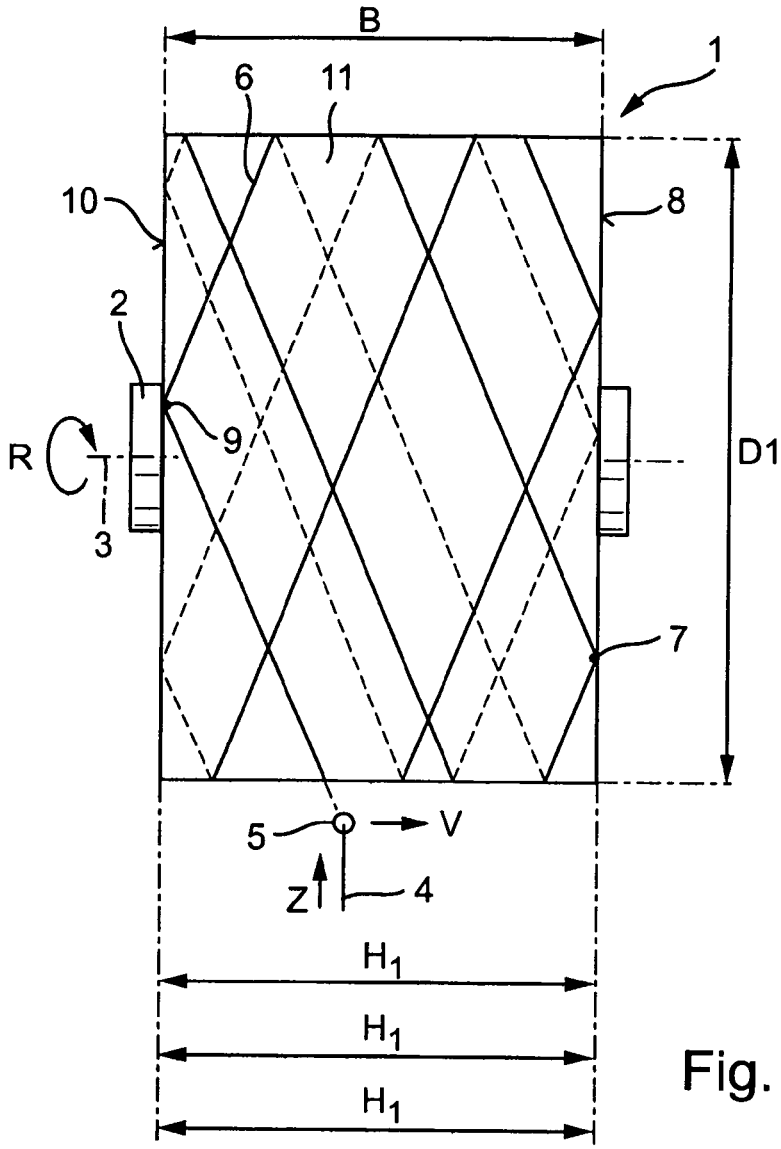

| | | | |
|---|---|---|---|
| DE | 1106219 | | 5/1961 |
| DE | 43 13 113 | A1 | 10/1993 |
| DE | 43 10 905 | A1 | 10/1994 |
| DE | 37 23 524 | C2 | 2/1998 |
| DE | 101 04 463 | A1 | 9/2002 |
| DE | 103 42 266 | A1 | 4/2004 |
| GB | 982273 | | 2/1965 |
| JP | 48 41050 | | 6/1973 |
| JP | 59 149272 | | 8/1984 |
| WO | 02/060800 | A1 | 8/2002 |

* cited by examiner

CROSSWOUND BOBBIN AND ASSOCIATED PRODUCTION METHOD

The invention relates to an overend take-off crosswound bobbin and to a method for its production in which at least one thread is wound on with a pitch angle which can be varied during the winding operation.

Crosswound bobbins are supply bobbins which during further processing can be used as feedstock for weaving or knitting machines. Unlike flanged bobbins they comprise a self-supporting crosswound package and have no end walls. A thread is wound on helically with a relatively large pitch angle so that the threads cross over one another many times and the individual thread layers are stabilized relative to one another.

WO 02/060800 A1 discloses the problems associated with the overend take-off of a crosswound bobbin. The rotational speed of the thread balloon which forms at a constant thread take-off speed varies as a function of the bobbin diameter and direction of movement of the detachment point of the thread from the crosswound package. At certain diameters the fluctuations in the rotational speed lead to a constant collapse of the thread balloon between a single and double balloon or between a double and triple balloon. The collapse of the thread balloon causes abrupt changes in the thread tension and may thus trigger thread breakages. In practice the take-off speed is limited by these tension peaks. WO 02/060800 A1 discloses reducing the fluctuations in thread tension by varying the pitch angle as a function of the direction of displacement.

The object on which the invention is based is to further improve the run-off characteristics of a crosswound bobbin and at the same time to achieve an increase in the bobbin density, or to increase the thread length stored in the crosswound package while maintaining the same external dimensions.

The object is achieved in one variant in that thread layers with parallel windings are present at certain intervals.

In another variant, the object is achieved in that the pitch angle is increased on average, as seen over a number of thread layers, with increasing bobbin diameter. A combination of the two variants is of course possible.

With small bobbin diameters the rotational speed of the thread balloon, and thus the thread tension, are significantly higher than for large diameters. Consequently, fluctuations in the rotational speed of the thread balloon lead particularly quickly here to thread breakages and should therefore be as small as possible. The smaller the pitch angle, the smaller the fluctuation in the rotational speed from layer to layer. A smaller pitch angle thus leads to better run-off characteristics. Furthermore, the bobbin density is increased. The extreme case is that of parallel windings. Here, the rotational speed of the thread balloon is virtually constant and the bobbin density becomes maximum. A uniform and relatively small pitch angle over the full diameter range of the crosswound bobbin has the disadvantage that during handling the stability of the finished bobbin is no longer ensured. For a high degree of stability for the crosswound package there needs to be sufficiently large pitch angle particularly in the outer diameter range. Therefore, a pitch angle which increases from the inside to the outside is particularly advantageous for an optimum bobbin structure.

It is equally advantageous for an optimum bobbin structure to introduce thread layers with parallel windings at certain intervals. These contribute to increasing the bobbin density without having the disadvantage that would be entailed by parallel winding alone, since the layers having parallel windings are enclosed by layers having a relatively large pitch angle, thereby effectively preventing the threads from hooking together.

In a further advantageous embodiment of the invention, provision is made to wind certain diameter ranges of the crosswound package with a varying traversing stroke. This improves the run-off properties of the crosswound bobbin further.

It is particularly advantageous for the aforementioned measures to be combined with the measures from WO 02/060800 A1.

It is advantageous to produce the crosswound package on a single traverse machine. On the other hand, it is unimportant whether the package is wound, for example, from a yarn, a twisted yarn, a filament or even from a double thread.

Further advantages and features of the invention will become apparent from the description of the exemplary embodiments given below.

Figure 2:
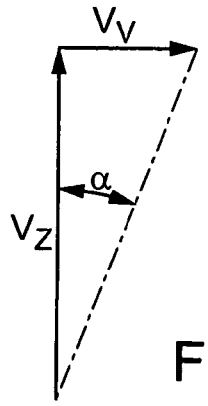
Figure 3:
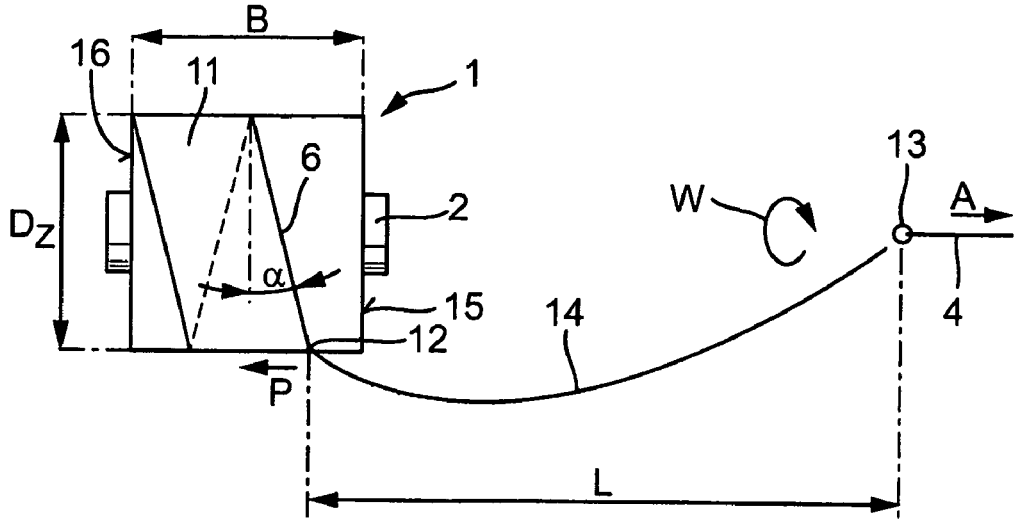
Figure 4:
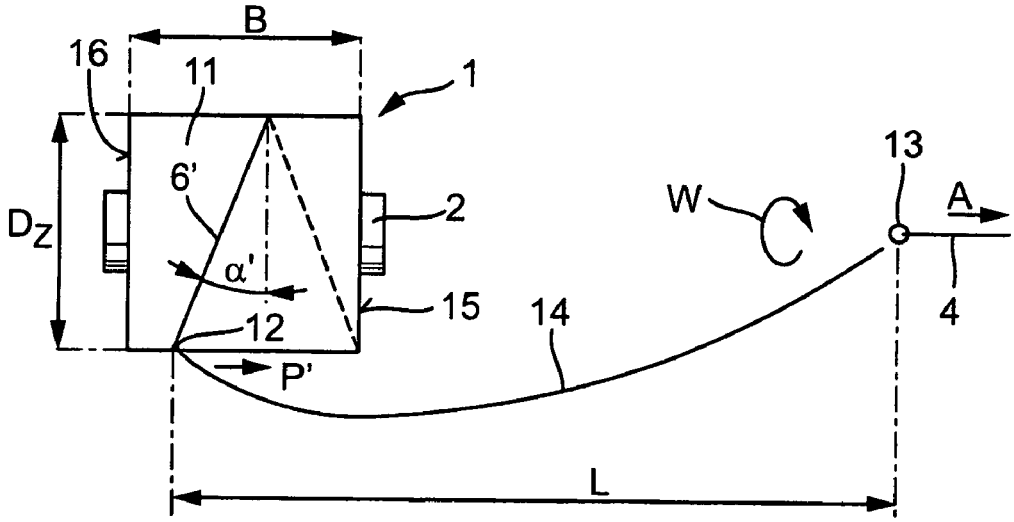
Figure 5:
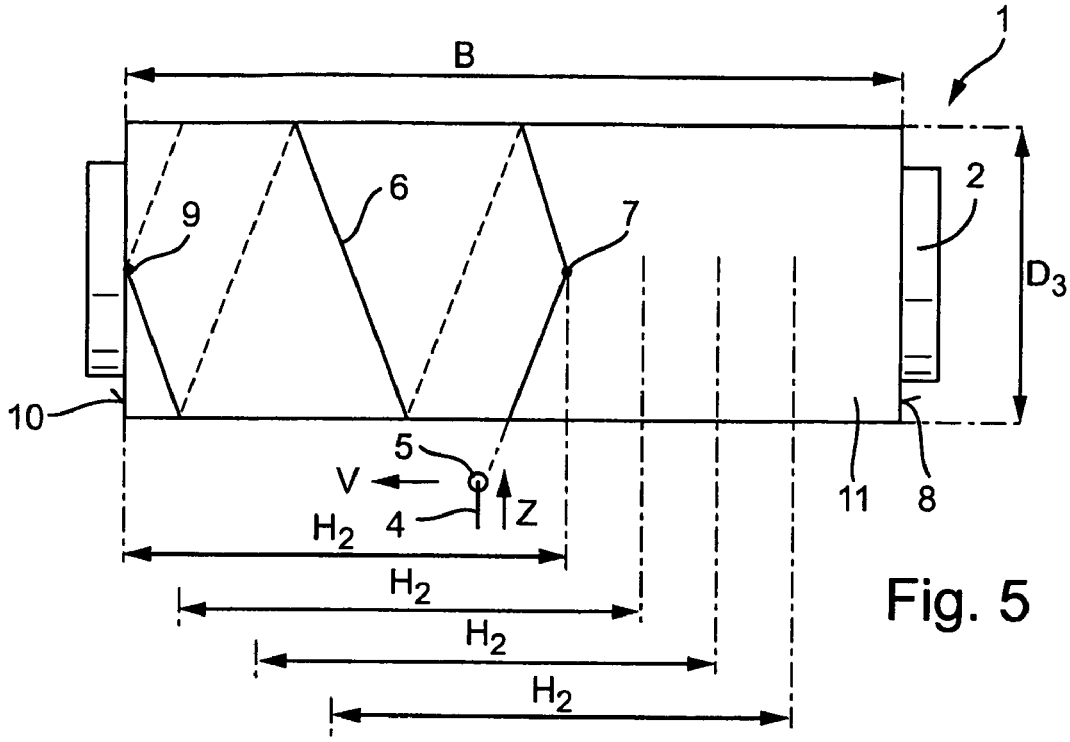
Figure 6:
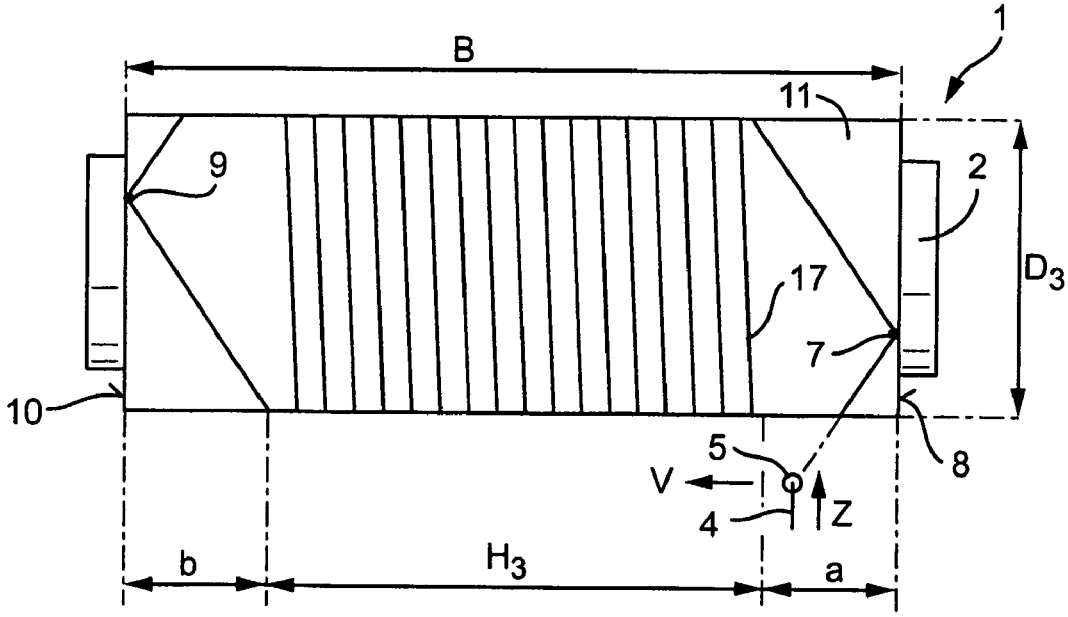

In the drawing:

FIG. 1 shows a schematic view of a crosswound bobbin when winding with a traversing motion over the entire bobbin width, FIG. 2 shows an illustration of the speed vectors and of the pitch angle, FIGS. 3 and 4 each show a view of a crosswound bobbin during overend take-off, FIG. 5 shows a schematic view of a crosswound bobbin when winding with a varying traversing stroke, and FIG. 6 shows a schematic view of a crosswound bobbin when winding with parallel windings.

FIG. 1 shows a crosswound bobbin 1 during its production. A bobbin tube 2 rotates in the direction R about its axis of symmetry 3 and a thread 4 is fed in at a constant delivery speed in the direction Z. During winding of the thread 4 onto the bobbin tube 2, it is simultaneously displaced parallel to the axis of symmetry 3 along the direction of displacement V. The displacement is brought about by a known traversing device, here indicated by the traversing thread guide 5, which moves at a traversing speed. The superimposition of the delivery and traversing movements means that the thread 4 is wound on helically with a pitch angle $\alpha$.

The definition of the pitch angle $\alpha$ is represented in FIG. 2. Here, the vectors of the delivery speed $v_z$ and of the traversing speed $v_v$ are plotted and show the relationship with the pitch angle $\alpha$. With a constant delivery speed $v_z$, the pitch angle $\alpha$ can be influenced by changing the traversing speed $v_v$.

The traversing thread guide 5 is moved to and fro with the stroke $H_1$ in and counter to the direction of displacement V. A thread layer results with each movement along the path $H_1$. The thread 4 of the outermost, completely finished thread layer is denoted by 6. The thread layer 6 extends from the point of reversal 7 on one bobbin side 8 to the second point of reversal 9 on the other bobbin side 10. The total of all the thread layers forms the crosswound package 11 of diameter $D_1$ and width B. Apart from a small traverse variation, the stroke $H_1$ is kept substantially constant, with the result that the width B of the resulting crosswound package 11 corresponds approximately to the stroke $H_1$.

FIGS. 3 and 4 show the situation during the overend take-off of a crosswound bobbin 1. The thread 4 is detached from the crosswound package 11 at a detachment point 12 and is taken off at a constant speed in direction A through the take-off eyelet 13. The crosswound package 1 and the take-off eyelet 13 are fixed in space. The thread 4 rotates in direction W about the crosswound package 11 and the free thread section between the detachment point 12 and take-off eyelet 13 forms the thread balloon 14, the detachment point 12 at the same time moving in direction P along the crosswound package 11. As the diameter $D_2$ of the crosswound package 11 decreases, the angular velocity of the thread balloon 14 increases. It is known from WO 02/060800 A1 that the angular velocity influences the shape of the thread balloon 14. It determines whether there is a sliding take-off or a single, double or triple balloon. It is also known that the angular velocity is dependent on the direction of movement P of the detachment point 12.

FIG. 3 shows the situation in which the detachment point 12 moves in direction P from the head side 15 of the crosswound package 11 that faces the take-off eyelet 13 to the foot side 16.

FIG. 4 shows a view of the crosswound bobbin 1 in which the detachment point 12 moves in direction P' toward the head side 15. The thread layer 6' taken off here is to be that thread layer which was situated directly below the thread layer 6 taken off in FIG. 3. Under this condition it can be assumed that the diameter $D_2$ of the crosswound package 11 is identical and consequently that the angular velocity resulting from the diameter $D_2$ would have to be identical. Nevertheless, given the same take-off speed, the angular velocity of the thread balloon 14 at the instant represented in FIG. 3 is higher than in the situation according to FIG. 4. The reason for this is that the thread balloon 14 is increased by the movement of the detachment point 12 in FIG. 3. Since the take-off speed is constant, the thread length required for increasing the thread balloon 14 must be provided by more rapidly unwinding from the crosswound package 11. According to WO 02/060800 A1, provision is made to reduce the increase in the angular velocity in the situation represented in FIG. 3 by reducing the pitch angle $\alpha$ in this thread layer. The fluctuations in angular velocity which cause the unwelcome collapse between the various shapes of the thread balloon 14 are intended to be diminished thereby.

Recent findings have shown that, in addition to the angular velocity, there is a further variable that influences the shape of the thread balloon 14. This is the distance L from the detachment point 12 to the take-off eyelet 13. Given a constant diameter $D_2$ and a constant angular velocity, changing the distance L also causes the shape of the thread balloon 14 to be collapse. Taking this finding into account, it is disadvantageous for the crosswound bobbin 1 to be wound with the traversing stroke $H_1$ over the entire width B. The dimension L fluctuates by the relatively large amount B in each thread layer. FIG. 5 shows how this disadvantage can be avoided. When winding the crosswound bobbin 1 the traversing thread guide 5 is not guided over the entire width B with the traversing stroke $H_1$; instead it is only moved to and fro with the reduced traversing stroke $H_2$. To produce a crosswound package 11 of width B, this traversing stroke $H_2$ is now displaced continuously or progressively along the bobbin width. During overend take-off, the distance L in each thread layer thus fluctuates only by the relatively small amount $H_2$. This results in the thread balloon 14 being made more uniform. Changing the distance L by the amount B now takes place slowly enough so as no longer to have a negative effect on the take-off conditions. This measure is effective particularly over small diameter ranges, at diameters below 200 to 300 mm, since it is below this diameter range that the collapsing of the thread balloon 14 occurs. Above 200 to 300 mm, the traversing stroke can be increased without problem to the amount $H_1$ since a relatively stable and nonsensitive single balloon then forms during overend take-off.

FIG. 5 also clearly shows the stabilizing influence of the bobbin tube 2. Here, the diameter $D_3$ of the crosswound package 11 is still relatively small and the supporting action of the bobbin tube 2 is still relatively large. By contrast with this, when the diameter $D_1$ is large, as represented in FIG. 1, it is required to a high degree that the crosswound package 11 is self-stabilizing. A decisive measure of the stability is the pitch angle $\alpha$. If the pitch angle $\alpha$ is too small, windings present at the bobbin sides 8, 10 may slough off and form unwelcome loose thread loops there, referred to as overthrown ends. The supporting action of the bobbin tube 2 can be advantageously exploited if the pitch angle $\alpha$ is kept small for a small diameter $D_3$ and the thread length stored in a thread layer is thus increased. It is only with a relatively large diameter $D_1$ that the pitch angle $\alpha$ is increased as well. As a result, the bobbin density and/or the wound-on thread length can be increased without losses in stability.

Of course, the pitch angle $\alpha$ will not be increased constantly with each thread layer. Rather, a combination of all the known measures will be used to improve the run-off properties. This means that the aforementioned increase in the pitch angle $\alpha$ with increasing diameter is to be regarded as an increase in the average value formed from the pitch angles of a number of adjacent thread layers.

FIG. 6 shows a representation of a thread layer having parallel windings 17 on a crosswound bobbin 1. Parallel windings 17 can be used with particular advantage as protective windings for separating various series of thread layers applied with a reduced and displaced traversing stroke $H_2$ according to FIG. 5. Moreover, parallel windings 17 allow the storage of the maximum thread length in a thread layer and thus likewise increase the bobbin density. To avoid overthrown ends, the parallel windings 17 should only start at a distance a from the bobbin side 8 and/or already end at a distance b from the bobbin side 10.

In the case of parallel windings 17, the pitch angle $\alpha$ is virtually zero, as a result of which the angular velocity of the thread balloon 14 during take-off virtually does not change as a function of the direction of movement P of the detachment point. However, when winding a number of thread layers having parallel windings 17 over one another there is a risk that threads 4 become clamped between the windings situated underneath. Therefore, it is advantageous for thread layers having parallel windings 17 to be wound on in an alternating arrangement with thread layers having a large pitch angle $\alpha$. Here, the layer arrangement can be advantageously controlled so that during overend take-off of the finished crosswound bobbin 1, the detachment point 12 moves according to FIG. 3 if a thread layer having parallel windings 17 is taken off. The increase in the angular velocity of the thread balloon 14 can thus be further reduced.

The invention claimed is:

1. Method for producing a crosswound package by which at least one thread is wound at a pitch angle which varies during the winding operation, wherein the at least one thread is wound in crosswindings at varying traversing strokes and wherein at certain time intervals one or more thread layers having parallel windings are wound on the crosswound layers, which layers having parallel windings start at a distance from the one edge of the package and end at a distance before the other edge of the package.

2. The method as claimed in claim 1, characterized in that the pitch angle increases on average, as seen over a number of thread layers, with increasing bobbin diameter.

3. The method as claimed in claim 1, characterized in that the parallel windings start at a distance after one bobbin edge and/or end at a distance before the other bobbin edge, the crosswound package having a plurality of thread layers, wherein, in at least a subset of the thread layers, an end of each layer fluctuates in distance from at least one bobbin edge relative to a distance of an adjacent layer from said at least one bobbin edge.

4. The method as claimed in claim 1, characterized in that the pitch angle is kept substantially constant over a certain period of time and is increased on reaching a defined bobbin diameter which, in turn, is then kept substantially constant over a certain period of time.

5. The method as claimed in claim 1, characterized in that the thread is wound on with a varying traversing stroke.

6. The method as claimed in claim 1, characterized in that a traversing stroke (H) which is reduced by comparison with the bobbin width is displaced at least periodically along the bobbin width.

7. The method as claimed in claim 1, characterized in that the pitch angle is varied with changing direction of displacement.

8. A crosswound package of at least one thread wound at varying pitch angles wherein layers of crosswindings are wound at varying lengths of traversing strokes and wherein layers of at least one parallel winding are arranged between the layers of crosswindings, which layers of parallel windings begin at a distance from the edge of the package and end at a distance from the other edge of the package.

9. The crosswound bobbin as claimed in claim 8, characterized in that the pitch angle of thread layers situated to the inside is on average, as seen over a number of thread layers, smaller than that of thread layers situated further to the outside.

10. The crosswound bobbin as claimed in claim 8, characterized in that the parallel windings start at a distance after one bobbin edge and/or end at a distance before the other bobbin edge.

11. The crosswound bobbin as claimed in claim 8, characterized in that the pitch angle is substantially constant over certain regions of thread layers, and in that the average pitch angle of a region situated to the inside is smaller than that of a region situated further to the outside.

12. The crosswound bobbin as claimed in claim 8, characterized in that there are thread layers which are wound on with a varying traversing stroke.

13. The crosswound bobbin as claimed in claim 8, characterized in that thread layers produced with a traversing stroke which is reduced by comparison with the bobbin width are wound on at least partially along the bobbin width with an offset with respect to one another.

14. The crosswound bobbin as claimed in claim 8, characterized in that the pitch angle ($\alpha$) is varied with changing direction of displacement.

* * * * *